US010600394B2

(12) United States Patent
Lin

(10) Patent No.: US 10,600,394 B2
(45) Date of Patent: Mar. 24, 2020

(54) CAJON PERCUSSION INSTRUMENT

(71) Applicant: E Bin Industrial Co., Ltd., Taichung (TW)

(72) Inventor: Hsi Tan Lin, Taichung (TW)

(73) Assignee: E BIN INDUSTRIAL CO., LTD., Taichung (TW)

( * ) Notice: Subject to any disclaimer, the term of this patent is extended or adjusted under 35 U.S.C. 154(b) by 0 days.

(21) Appl. No.: 16/239,322

(22) Filed: Jan. 3, 2019

(65) Prior Publication Data

US 2019/0392791 A1 Dec. 26, 2019

(30) Foreign Application Priority Data

Jun. 26, 2018 (TW) ..... 107208584 U

(51) Int. Cl.
*G10D 13/02* (2020.01)
*G10D 13/00* (2020.01)

(52) U.S. Cl.
CPC ..... *G10D 13/006* (2013.01)

(58) Field of Classification Search
CPC ..... G10D 13/006
See application file for complete search history.

(56) References Cited

U.S. PATENT DOCUMENTS 1,808,085 A * 6/1931 Troppe ..... G10D 13/006 84/422.1
2,548,271 A * 4/1951 Percy ..... G10D 13/006 84/411 R
2,581,515 A * 1/1952 Christian ..... G10D 13/006 84/422.1
3,747,464 A * 7/1973 Russell ..... G10D 13/006 84/422.1
4,747,333 A * 5/1988 Hoshino ..... G10D 13/006 84/422.1
5,267,500 A * 12/1993 Lombardi ..... G10D 13/065 84/402
5,438,903 A * 8/1995 Cropek ..... G10D 13/006 84/422.3
5,458,039 A * 10/1995 Ashby ..... G10D 13/006 84/422.1
7,365,258 B1 * 4/2008 Lombardi ..... G10D 13/006 84/422.1

(Continued)

*Primary Examiner* — Robert W Horn
(74) *Attorney, Agent, or Firm* — Muncy, Geissler, Olds & Lowe, PC

(57) ABSTRACT

A cajón percussion instrument includes a mallet mechanism and a pedal mechanism. The mallet mechanism has a first upright frame disposed on a first bottom plate. A first rotating member is insertedly connected to the first upright frame. The first rotating member is provided with a mallet. The pedal mechanism has a second upright frame disposed on a second bottom plate. A second rotating shaft is insertedly connected to the second upright frame. Two ends of a pedal are pivotally connected to the second bottom plate and the second rotating member, respectively. A fixing seat is provided on each of the first bottom plate and the second bottom plate. A sleeve is connected to the second fixing seat. The sleeve is configured to receive a cable therein. Two ends of the cable are connected to the first rotating member and the second rotating member, respectively.

7 Claims, 7 Drawing Sheets

(56) References Cited

U.S. PATENT DOCUMENTS

| | | | | |
|---|---|---|---|---|
| 7,692,083 | B2 * | 4/2010 | Aspland | G10D 13/006 84/415 |
| 8,624,097 | B1 * | 1/2014 | Liao | G10D 13/006 84/422.1 |
| 8,835,735 | B1 * | 9/2014 | Lin | G10D 13/006 84/422.3 |
| 8,859,870 | B2 * | 10/2014 | Yamane | G10D 13/024 84/422.1 |
| 8,884,145 | B1 * | 11/2014 | Lin | G10D 13/02 84/422.1 |
| 9,466,272 | B1 * | 10/2016 | Lin | G10D 13/006 |
| 9,875,730 | B2 * | 1/2018 | Cannon | G10D 13/006 |
| 10,366,683 | B2 * | 7/2019 | Iio | G10D 13/00 |
| 2007/0234876 | A1 * | 10/2007 | Veiga | G10D 13/006 84/422.1 |
| 2012/0097011 | A1 * | 4/2012 | Leopold | G10D 13/003 84/422.4 |
| 2015/0059555 | A1 | 3/2015 | Liao | |
| 2017/0206868 | A1 * | 7/2017 | Sikra | G10D 13/006 |
| 2019/0156796 | A1 * | 5/2019 | Sikra | G10D 13/006 |

* cited by examiner

CAJON PERCUSSION INSTRUMENT

FIELD OF THE INVENTION

The present invention relates to a percussion instrument, and more particularly to a cajón percussion instrument.

BACKGROUND OF THE INVENTION

US Patent Application Early Publication No. US20170206868A1, U.S. Pat. No. 8,624,097B1 and US Patent Application Early Publication No. US20150059555A1 disclose a cajón percussion instrument. The cajón percussion instrument is composed of a mallet assembly, a pedal assembly and a sleeve. Two ends of the sleeve are fixed to the mallet assembly and the pedal assembly, respectively. A cable passes through the sleeve. Two ends of the cable are connected to the mallet assembly and the pedal assembly, respectively. The cable is pulled by stepping on the pedal assembly, and the mallet assembly is pulled by the cable to strike the cajón. However, the sleeves of the above-mentioned three cajón percussion instruments are arranged in a curved shape and have a considerable curvature, so the cable passing through the sleeve will be flexibly deformed along the sleeve. The cable is in contact with the inner wall surface of the sleeve, leading to a significant increase in the frictional resistance of the cable. When the user steps on the pedal assembly to pull the cable to drive the mallet assembly to strike the cajón, the user needs to exert a great force to pull the cable. After a period of time, the user may have aches in the foot.

Accordingly, the inventor of the present invention has devoted himself based on his many years of practical experiences to solve these problems.

SUMMARY OF THE INVENTION

The present invention is to provide a cajón percussion instrument. Through the technique of arranging a cable, a mallet mechanism and a pedaling mechanism in a straight line and reducing the contact between the cable and a sleeve, the force required for pulling the cable is reduced greatly, thereby achieving the labor-saving effect.

In order to achieve the aforesaid object, a cajón percussion instrument is provided. The cajón percussion instrument comprises a mallet mechanism and a pedal mechanism.

The mallet mechanism has a first bottom plate and a first upright frame disposed on the first bottom plate. A first rotating member is insertedly connected to the first upright frame. A mallet and a first cable rotating member are disposed on the first rotating member. The first cable rotating member has a first connecting portion. One end of a cable is connected to the first connecting portion. A first fixing seat is provided on the first bottom plate. One end of a sleeve is connected to the first fixing seat. The cable is inserted into the sleeve.

The pedal mechanism has a second bottom plate and a second upright frame disposed on the second bottom plate. A second rotating shaft is insertedly connected to the second upright frame. Two ends of a pedal are pivotally connected to the second bottom plate and the second rotating member, respectively. One end of the second rotating shaft is provided with a second cable rotating member. The second cable rotating member has a second connecting portion. Another end of the cable is connected to the second connecting portion. A second fixing seat is provided on the second bottom plate. Another end of the sleeve is connected to the second fixing seat.

An extending direction of the first rotating shaft is defined as a first axis. An extending direction of the second rotating shaft is defined as a second axis. A linear distance between the first connecting portion and the second connecting portion is defined as a third axis. The first axis and the second axis are spaced apart from each other. The third axis is located between the first axis and the second axis. An included angle is defined between the third axis and the first axis as well as between the third axis and the second axis. The cable and the sleeve are disposed along the third axis.

Preferably, one end of the first rotating shaft is provided with the first cable rotating member. Another end of the first rotating shaft is provided with a spring rotating member. A spring fixing seat is provided on the first bottom plate. Two ends of a spring are connected to the spring fixing seat and the spring rotating member, respectively.

Preferably, the spring fixing seat has an aperture and a screw member passing through the aperture. An outer periphery of the screw member has a threaded portion. The screw member has a head end at one side of the threaded portion and a hook hole at another side of the threaded portion. A nut is disposed on the threaded portion. The screw member is clamped to the spring fixing seat by the head end and the nut. The hook hole of the screw member is connected with the spring.

Preferably, the first cable rotating member is substantially T-shaped and has an upper portion parallel to the first rotating shaft and a lower portion perpendicular to the upper portion. The upper portion has a connecting hole corresponding to the first rotating shaft. The first cable rotating member is sleeved on the first rotating shaft through the connecting hole of the upper portion. The lower portion has a screw hole therein. The first connecting portion is a screw corresponding to the screw hole. The screw is screwed to the screw hole. The screw has a connecting end extending out of the screw hole. The connecting end has a through hole. One end of the cable passes through the through hole and is fixedly connected to the screw.

Preferably, a soft block is provided in the through hole. The cable passes through the soft block and is positioned in the through hole of the first cable rotating member.

Preferably, the second cable rotating member is substantially T-shaped and has an upper portion parallel to the second rotating shaft and a lower portion perpendicular to the upper portion. The upper portion has a connecting hole corresponding to the second rotating shaft. The second cable rotating member is sleeved on the second rotating shaft through the connecting hole of the upper portion. The lower portion has a screw hole therein. The second connecting portion is a screw corresponding to the screw hole. The screw is screwed to the screw hole. The screw has a connecting end extending out of the screw hole. The connecting end has a through hole. The other end of the cable passes through the through hole and is fixedly connected to the screw.

Preferably, a soft block is provided in the through hole. The cable passes through the soft block and is positioned in the through hole of the second cable rotating member.

The above objects and advantages of the present invention will be readily understood from the following detailed description of the embodiments of the invention.

DETAILED DESCRIPTION OF THE PREFERRED EMBODIMENTS

Referring to FIGS. 1 to 7, embodiments of the present invention will now be described, by way of example only, with reference to the accompanying drawings.

Figure 1:
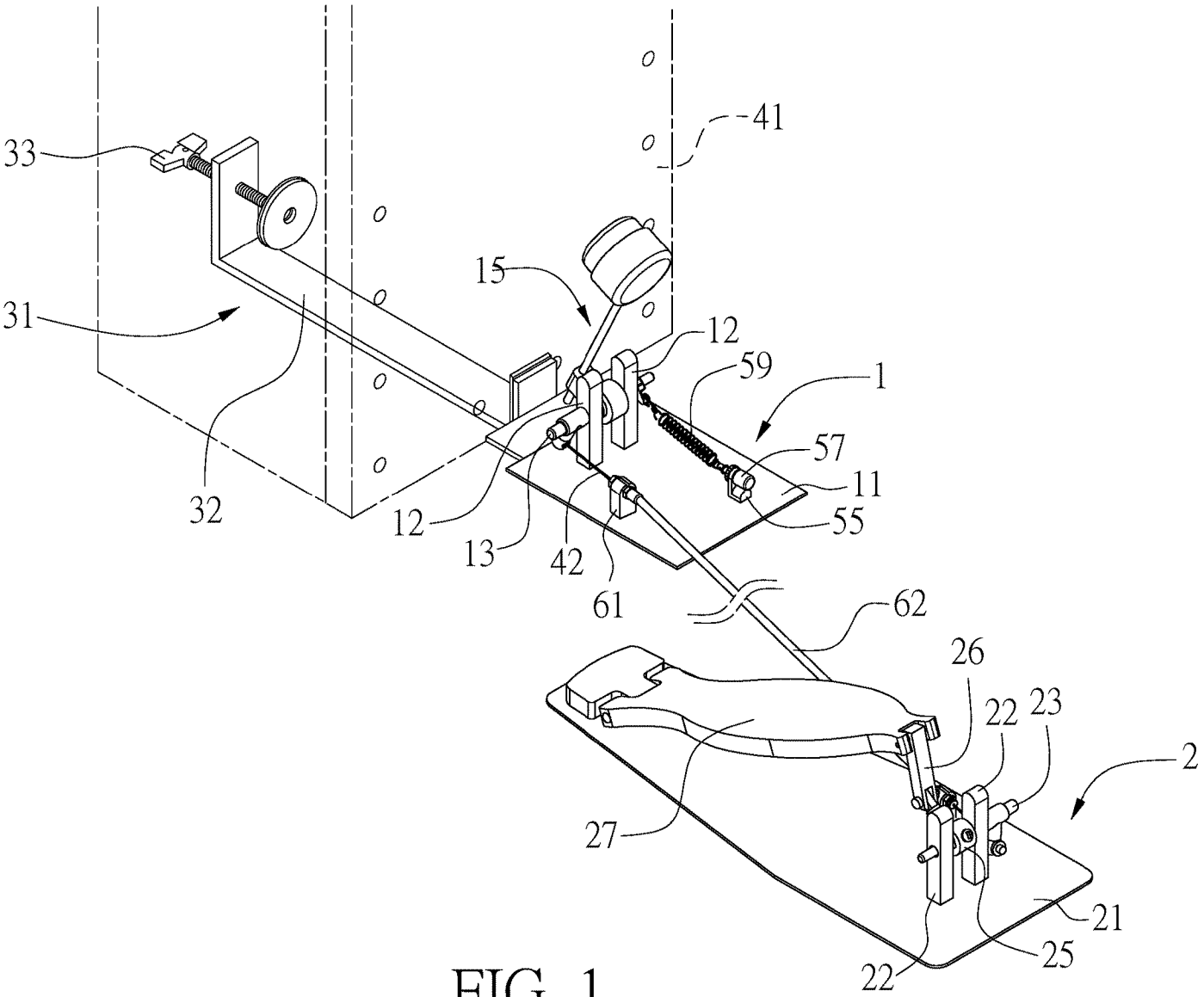
FIG. 1 is a perspective view of the present invention.
Figure 2:
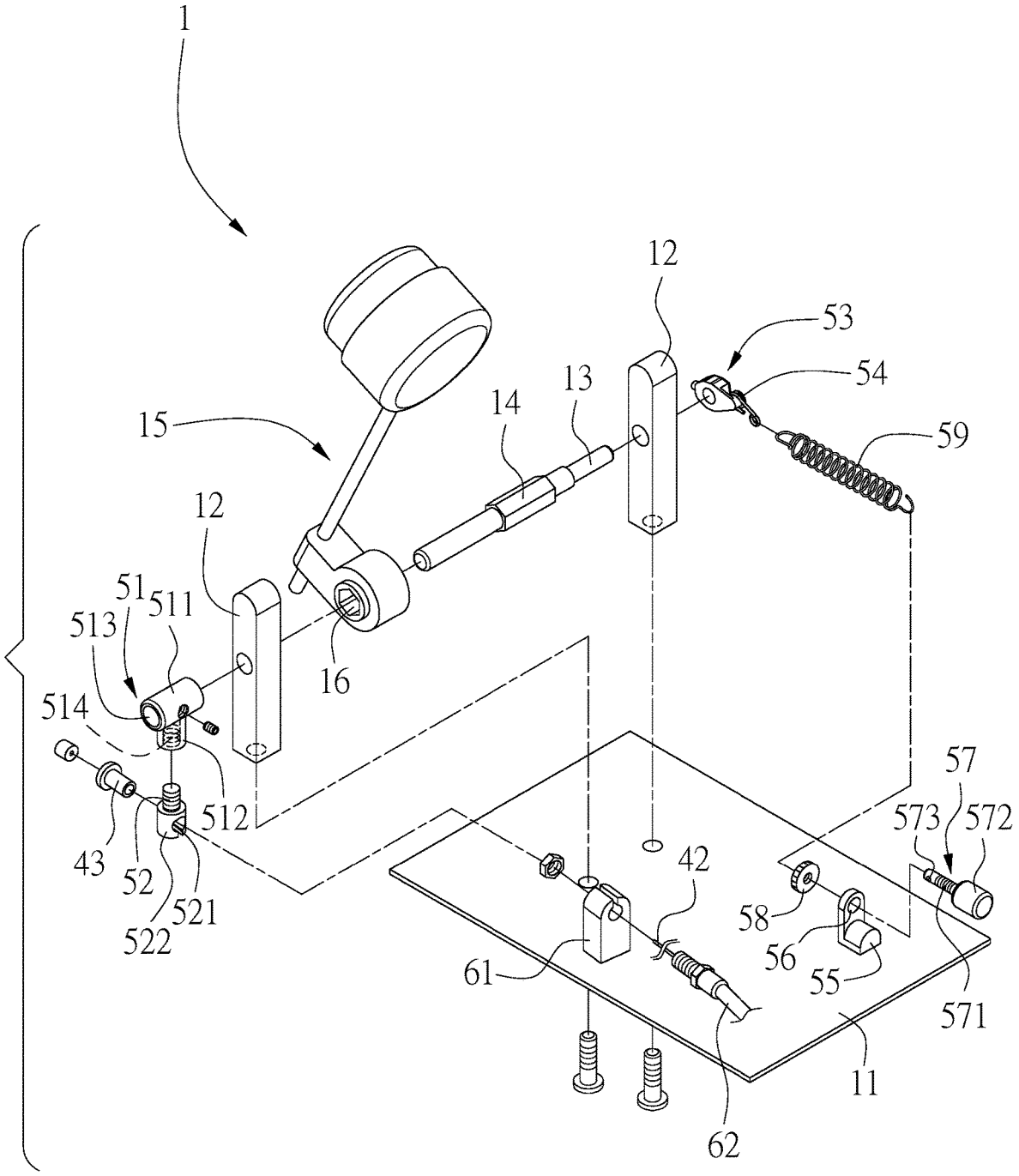
FIG. 2 is an exploded view of the mallet mechanism of the present invention.
Figure 3:
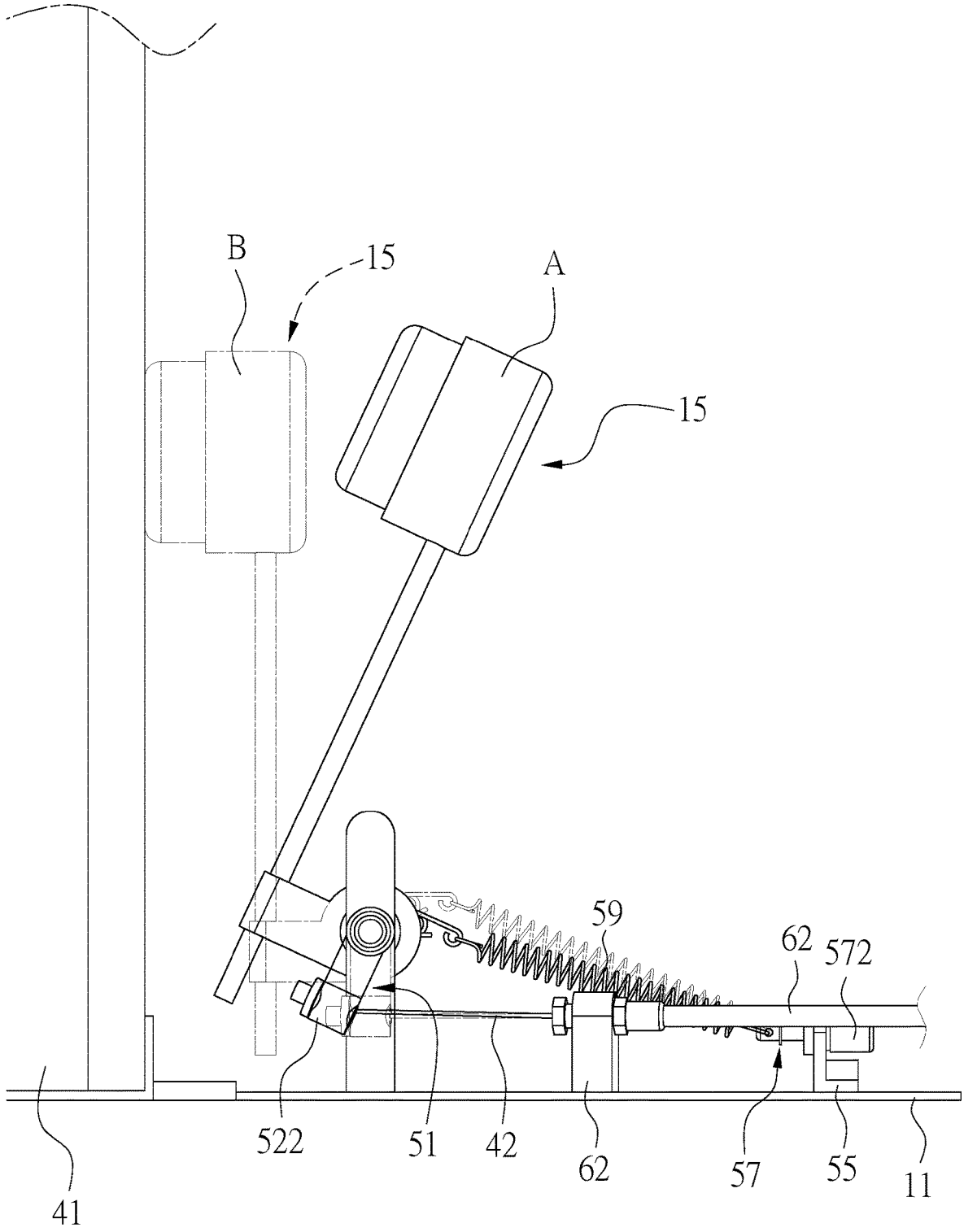
FIG. 3 is a schematic view of the present invention when in use, showing that the mallet is pivoted between the initial position and the striking position.

As shown in FIGS. 1 to 3, the present invention discloses a cajón percussion instrument which is mainly composed of a mallet mechanism 1 and a pedal mechanism 2.

The mallet mechanism 1 has a first bottom plate 11 and a first upright frame disposed on the first bottom plate 11. A fixing device 31 is disposed at a front end of the first bottom plate 11. The fixing device 31 is composed of a U-shaped clamping member 32 and a locking member 33 screwedly connected to the clamping member 32. A cajón 41 is disposed on the clamping member 32. The locking member 33 is screwed towards the cajón 41, so that the cajón 41 is clamped on the fixing device 31 through the end faces of the clamping member 32 and the locking member 33. In this embodiment, the first upright frame is composed of two plate members 12. A first rotating shaft 13 is insertedly connected to the two plate members 12. The first rotating shaft 13 is formed with a first restricting portion 14 having a substantially hexagonal cross section between the two plate members 12. A mallet 15 is provided with an opening 16 corresponding in shape to the first restricting portion 14. The opening 16 of the mallet 15 is engaged with the first restricting portion 14, so that the rotation of the first rotating shaft 13 can drive the mallet 15 to be displaced between an initial position A and a striking position B (as shown in FIG. 3). When the mallet 15 is moved from the initial position A to the striking position B, the mallet 15 is pivoted toward the cajón 41 and strikes the cajón 41. One end of the first rotating shaft 13 is provided with a first cable rotating member 51. The first cable rotating member 51 has a first connecting portion. One end of a cable 42 is connected to the first connecting portion. In this embodiment, the first cable rotating member 51 is substantially T-shaped and has an upper portion 511 parallel to the first rotating shaft 13 and a lower portion 512 perpendicular to the upper portion 511. The upper portion 511 has a connecting hole 513 corresponding to the first rotating shaft 13. The first cable rotating member 51 is sleeved on the first rotating shaft 13 through the connecting hole 513 of the upper portion 511. The lower portion 512 has a screw hole 514 therein. The first connecting portion is a screw 52 corresponding to the screw hole 514. The screw 52 is screwed to the screw hole 514. The screw 52 has a connecting end 522 extending out of the screw hole 514. The connecting end 522 has a through hole 521. One end of the cable 42 passes through the through hole 521 and is fixedly connected to the screw 52. Another end of the first rotating shaft 13 is provided with a spring rotating member 53. The spring rotating member 53 has a hook portion 54. The first bottom plate 11 is provided with a spring fixing seat 55 spaced apart from the first upright frame. The spring fixing seat 55 has an aperture 56. A screw member 57 passes through the aperture 56. The outer periphery of the screw member 57 has a threaded portion 571. The screw member 57 has a head end 572 at one side of the threaded portion 571 and a hook hole 573 at another side of the threaded portion 571. A nut 58 is disposed on the threaded portion 571, such that the screw member 57 is clamped to the spring fixing seat 55 by the head end 572 and the nut 58. A spring 59 has two ends respectively connected to the hook hole 573 of the screw member 57 and the hook portion 54 of the spring rotating member 53. The spring 59 can pull the spring rotating member 53 to drive the first rotating shaft 13 to rotate, thereby maintaining the mallet 15 in the initial position by the pulling of the spring 59. The first bottom plate 11 is provided with a first fixing seat 61 spaced apart from the two plate members 12. One end of a sleeve 62 is connected to the first fixing seat 61. In this embodiment, the sleeve 62 is a hollow plastic tube. The cable 42 is inserted into the sleeve 62, thereby making the cable 42 less susceptible to damage and rust.

Figure 4:
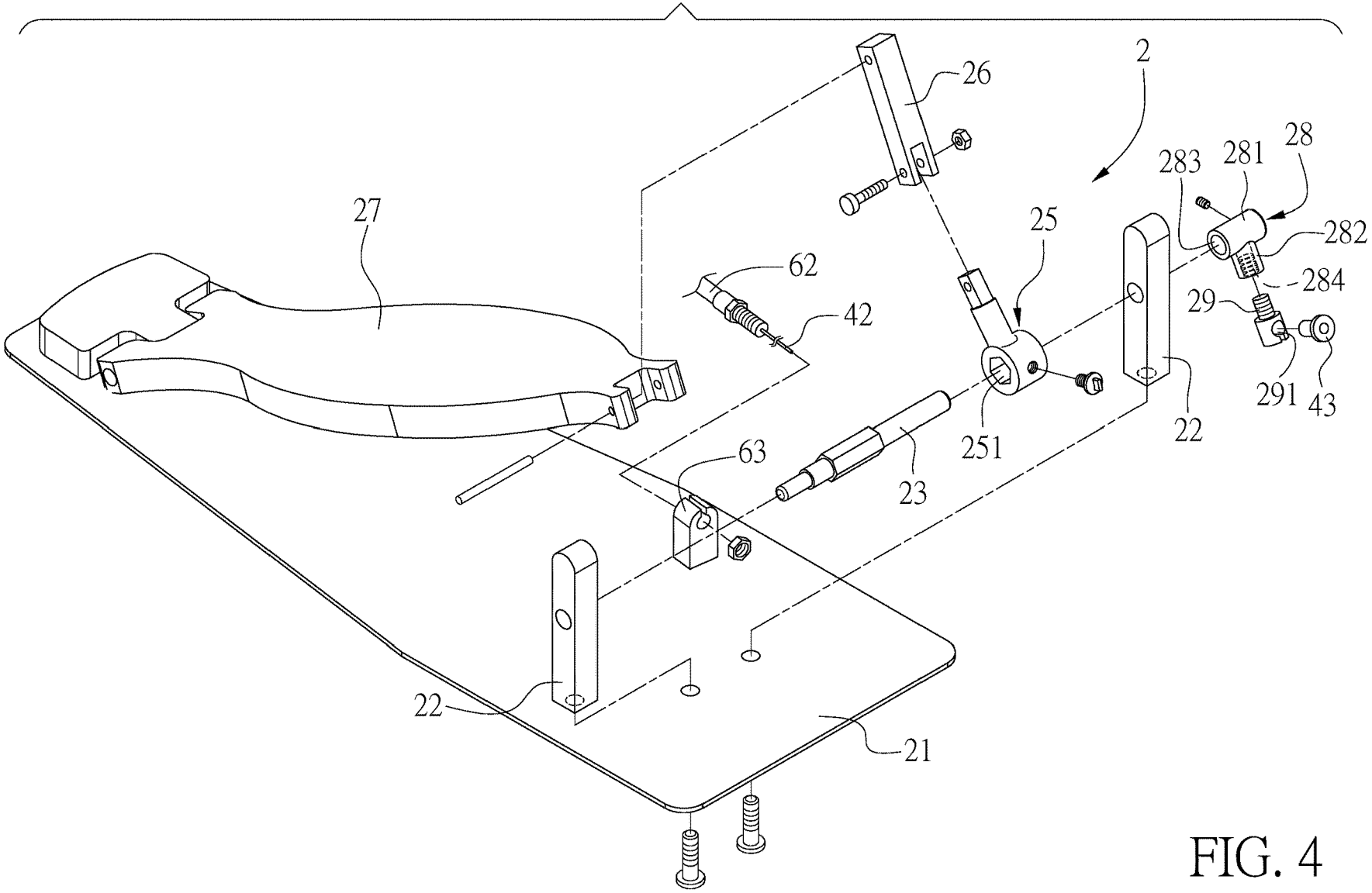
FIG. 4 is an exploded view of the pedal mechanism of the present invention.

As shown in FIG. 4, the pedal mechanism 2 has a second bottom plate 21 and a second upright frame disposed on the second bottom plate 21. The second upright frame is composed of two plate members 22. A second rotating shaft 23 is insertedly connected to the two plate members 22. The second rotating shaft 23 is formed with a second restricting portion 24 having a substantially hexagonal cross section between the two plate members 22. A connecting seat 25 is provided with an opening 251 corresponding in shape to the second restricting portion 24. The second restricting portion 24 is fixedly connected to the connecting seat 25. The opening 251 of the connecting seat 25 is engaged with the second restricting portion 24. One end of a linking rod 26 is pivotally connected to the connecting seat 25. Another end of the linking rod 26 is pivotally connected to one end of a pedal 27. Another end of the pedal 27 is pivotally connected to the second bottom plate 21. One end of the second rotating shaft 23 is provided with a second cable rotating member 28. The second cable rotating member 28 has a second connecting portion. Another end of the cable 42 is connected to the second connecting portion. In this embodiment, the second cable rotating member 28 is substantially T-shaped and has an upper portion 281 parallel to the second rotating shaft 23 and a lower portion 282 perpendicular to the upper portion 281. The upper portion 281 has a connecting hole 283 corresponding to the second rotating shaft 23. The second cable rotating member 28 is sleeved on the second rotating shaft 23 through the connecting hole 283 of the upper portion 281. The lower portion 282 has a screw hole 284 therein. The second connecting portion is a screw 29 corresponding to the screw hole 284. The screw 29 is screwed to the screw hole 284. The screw 29 has a connecting end 292 extending out of the screw hole 284. The connecting end 292 has a through hole 291. The other end of the cable 42 passes through the through hole 291 and is fixedly connected to the screw 29. A second fixing seat 63 is provided on the second bottom plate 21. Another end of the sleeve 62 is connected to the second fixing seat 63. When the pedal 27 is applied with an external force, the pedal 27 links the linking rod 26 to drive the connecting seat 25, thereby rotating the second rotating shaft 23 and simultaneously driving the second cable rotating member 28 to deflect. In this way, the cable 42 is pulled by the second connecting portion, and then the cable 42 is driven to synchronously pull the first cable rotating member 51 to deflect, so that the first cable rotating member 51 links the first rotating shaft 13, and the mallet 15 is pivoted to the striking position B to strike the cajón 41. In this embodiment, the first connecting portion and the second connecting portion include soft blocks 43 in the through holes 521, 291. The cable 42 passes through the soft blocks 43 and is positioned in the through holes of the first connecting portion and the second connecting portion, so that the frictional resistance between the cable 42 and the through holes 521, 291 can be reduced through the soft blocks 43 to prevent the cable 42 from being worn and broken.

Figure 5:
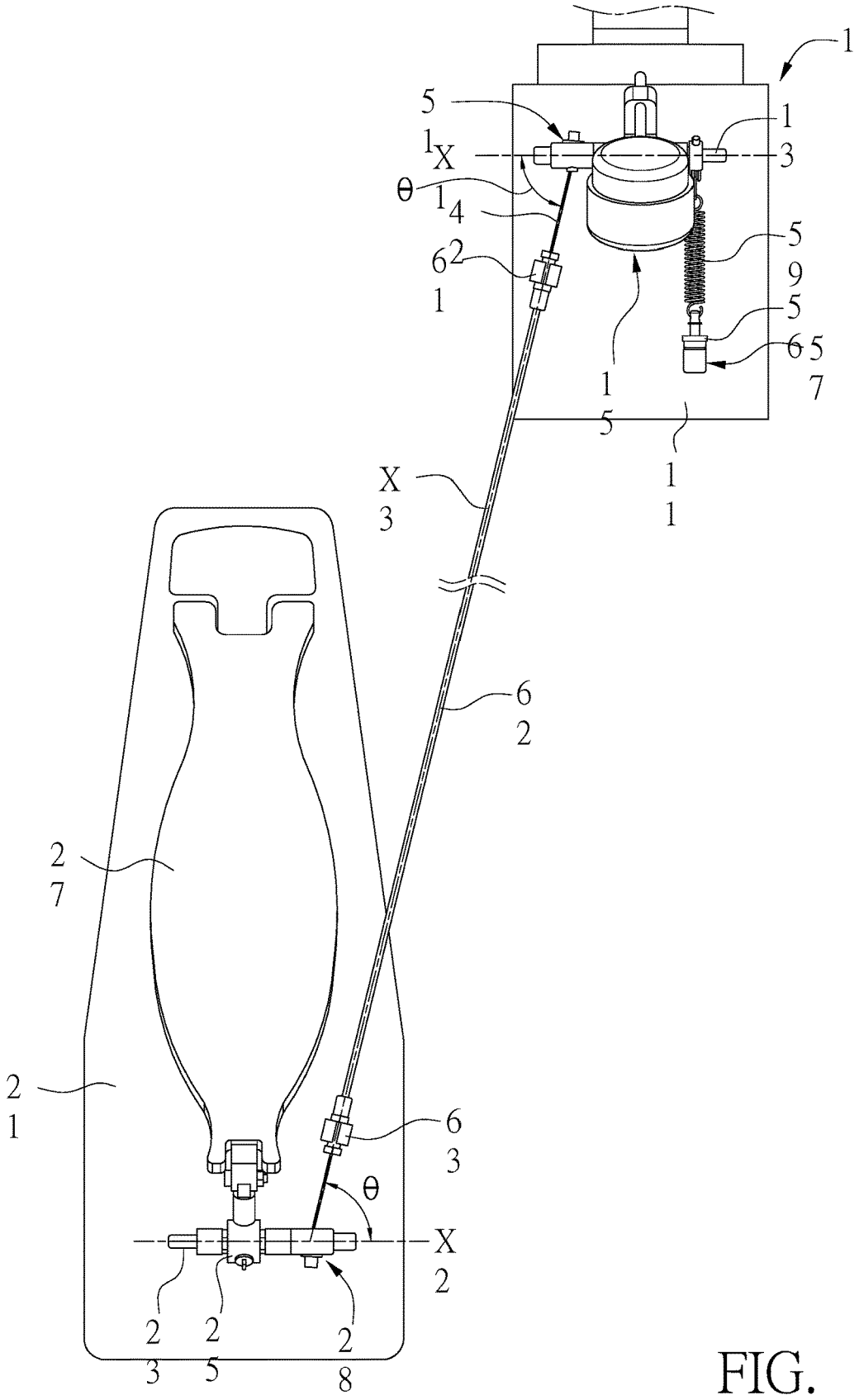
FIG. 5 is a top view of the present invention.

Preferably, the arrangement of the mallet mechanism 1 and the pedal mechanism is shown in FIG. 5. The extending direction of the first rotating shaft 13 is defined as a first axis X1. The extending direction of the second rotating shaft 23 is defined as a second axis X2. The linear distance between the first connecting portion and the second connecting portion is defined as a third axis X3. The third axis X3 is located between the first axis X1 and the second axis X2. In this embodiment, the first axis X1 and the second axis X2 are parallel to each other. An included angle θ is defined between the third axis X3 and the first axis X1 as well as between the third axis X3 and the second axis X2. The cable 42 and the sleeve 62 are disposed along the third axis X3.

Figure 6:
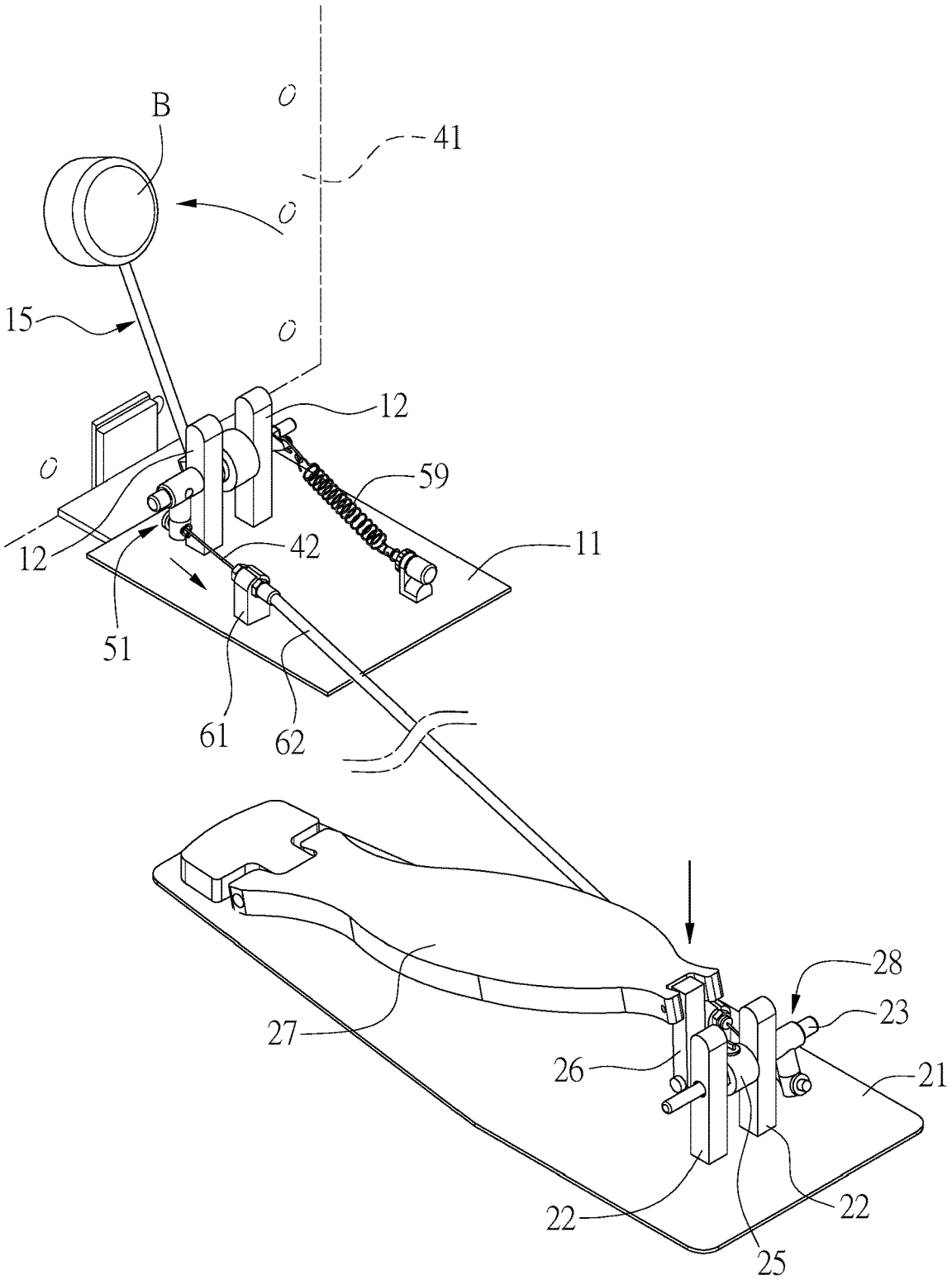
FIG. 6 is a schematic view of the present invention when in use, showing that the mallet is pivoted to the striking position and strike the cajón.
Figure 7:
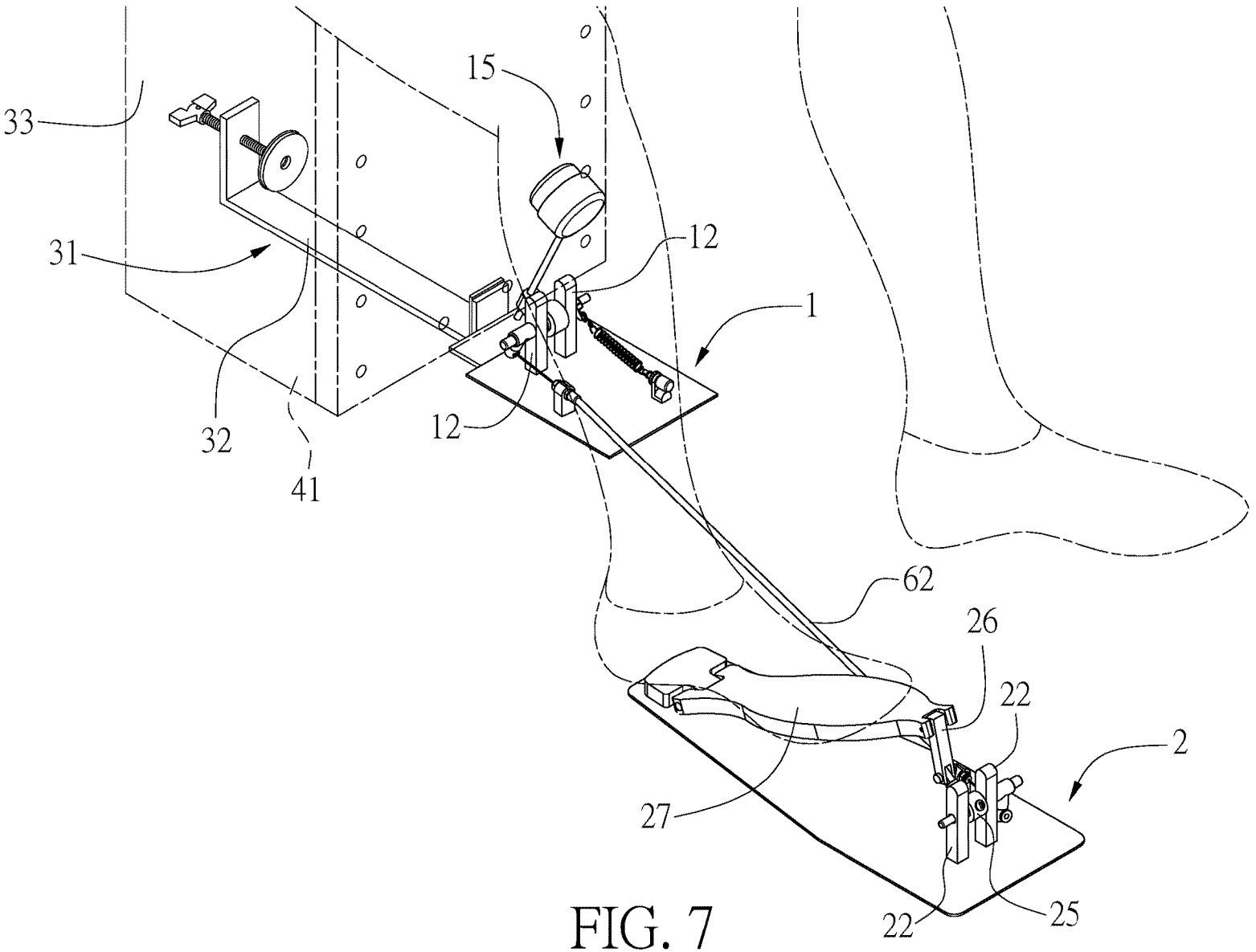
FIG. 7 is a schematic view of the present invention when in use, showing that the user steps on the pedal.

FIG. 6 and FIG. 7 illustrate the actual use of the present invention composed of the above-mentioned structures. The user applies an external force by stepping on the pedal 27, and the pedal 27 links the linking rod 26 to drive the connecting seat 25 to move, thereby rotating the second rotating shaft 23 and simultaneously driving the second cable rotating member 28 to deflect, so that the second connecting portion drives the cable 42 to pull the first cable rotating member 51 to deflect, the first cable rotating member 51 links the first rotating shaft 13 to rotate, the mallet 15 is pivoted from the initial position A to the striking position B to strike the cajón 41. When the first rotating shaft 13 is rotated, the hook portion 54 of the spring rotating member 53 is also pulled to pull the spring 59 to be stretched and deformed. When the user stops applying an external force to the pedal 27, the spring rotating member 53 is deflected by the return elastic force of the spring 59, thereby rotating the first rotating shaft 13 and pivoting the mallet 15 to the initial position A. When the first rotating shaft 13 is rotated, the first cable rotating member 51 is driven to pull the cable 42 and further to pull the second rotating shaft 23 to rotate, so that the linking rod 26 of the second rotating shaft 23 pulls the pedal 27 to a position when the user is not stepping on for the user to step on it again.

Through the cable 42 and the sleeve 62 arranged along the third axis X3, the present invention can reduce the flexural deformation of the sleeve 62 and the cable 42 effectively. When the user steps on the pedal 27 to link the second cable rotating member 28, there is no need to apply a great force to pull the cable 42 for pivoting the mallet 15. It is easy to step on the pedal 27 for pivoting the mallet 15 to the striking position B to strike the cajón 41, thereby saving labor. Furthermore, the two ends of the cable 42 are disposed in the through holes 521, 291 respectively via the soft blocks 43, and the friction between the cable 42 and the through holes 521, 291 is reduced effectively when the cable 42 is pulled, thereby preventing the cable 42 from being worn and broken so as to prolong the service life of the cable 42.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A cajón percussion instrument, comprising:

a mallet mechanism, having a first bottom plate and a first upright frame disposed on the first bottom plate, a first rotating member is insertedly connected to the first upright frame, a mallet and a first cable rotating member being disposed on the first rotating member, the first cable rotating member having a first connecting portion, one end of a cable being connected to the first connecting portion; a first fixing seat being provided on the first bottom plate, one end of a sleeve being connected to the first fixing seat, the cable being inserted into the sleeve;

a pedal mechanism, having a second bottom plate and a second upright frame disposed on the second bottom plate, a second rotating shaft being insertedly connected to the second upright frame, two ends of a pedal being pivotally connected to the second bottom plate and the second rotating member respectively, one end of the second rotating shaft being provided with a second cable rotating member, the second cable rotating member having a second connecting portion, another end of the cable being connected to the second connecting portion; a second fixing seat being provided on the second bottom plate, another end of the sleeve being connected to the second fixing seat;

wherein an extending direction of the first rotating shaft is defined as a first axis, an extending direction of the second rotating shaft is defined as a second axis, a linear distance between the first connecting portion and the second connecting portion is defined as a third axis, the first axis and the second axis are spaced apart from each other, the third axis is located between the first axis and the second axis, an included angle is defined between the third axis and the first axis as well as between the third axis and the second axis, the cable and the sleeve are disposed along the third axis, wherein the third axis is a straight line parallel to a surface of the first bottom plate of the mallet mechanism and a surface the second bottom plate of the pedal mechanism.

2. The cajón percussion instrument as claimed in claim 1, wherein one end of the first rotating shaft is provided with the first cable rotating member, another end of the first rotating shaft is provided with a spring rotating member, a spring fixing seat is provided on the first bottom plate, and two ends of a spring are connected to the spring fixing seat and the spring rotating member, respectively.

3. The cajón percussion instrument as claimed in claim 2, wherein the spring fixing seat has an aperture and a screw member passing through the aperture, an outer periphery of the screw member has a threaded portion, the screw member has a head end at one side of the threaded portion and a hook hole at another side of the threaded portion, a nut is disposed on the threaded portion, the screw member is clamped to the spring fixing seat by the head end and the nut, and the hook hole of the screw member is connected with the spring.

4. The cajón percussion instrument as claimed in claim 1, wherein the first cable rotating member is substantially T-shaped and has an upper portion parallel to the first rotating shaft and a lower portion perpendicular to the upper portion, the upper portion has a connecting hole corresponding to the first rotating shaft, the first cable rotating member is sleeved on the first rotating shaft through the connecting hole of the upper portion, the lower portion has a screw hole therein, the first connecting portion is a screw corresponding to the screw hole, the screw is screwed to the screw hole, the screw has a connecting end extending out of the screw hole, the connecting end has a through hole, and one end of the cable passes through the through hole and is fixedly connected to the screw.

5. The cajón percussion instrument as claimed in claim 4, wherein a soft block is provided in the through hole, and the cable passes through the soft block and is positioned in the through hole of the first cable rotating member.

6. The cajón percussion instrument as claimed in claim 1, wherein the second cable rotating member is substantially T-shaped and has an upper portion parallel to the second rotating shaft and a lower portion perpendicular to the upper portion, the upper portion has a connecting hole corresponding to the second rotating shaft, the second cable rotating member is sleeved on the second rotating shaft through the connecting hole of the upper portion, the lower portion has a screw hole therein, the second connecting portion is a screw corresponding to the screw hole, the screw is screwed to the screw hole, the screw has a connecting end extending out of the screw hole, the connecting end has a through hole, the other end of the cable passes through the through hole and is fixedly connected to the screw.

7. The cajón percussion instrument as claimed in claim 6, wherein a soft block is provided in the through hole, and the cable passes through the soft block and is positioned in the through hole of the second cable rotating member.

* * * * *